US009908725B2

(12) United States Patent
Takanaga et al.

(10) Patent No.: US 9,908,725 B2
(45) Date of Patent: Mar. 6, 2018

(54) SHEET MATERIAL SEPARATION-AIDING APPARATUS

(71) Applicant: OYABE SEIKI CO., LTD, Toyama (JP)

(72) Inventors: Masashi Takanaga, Toyama (JP); Masahiro Habashima, Toyama (JP); Hironobu Suna, Toyama (JP)

(73) Assignee: OYABE SEIKI CO., LTD, Toyama (JP)

( * ) Notice: Subject to any disclaimer, the term of this patent is extended or adjusted under 35 U.S.C. 154(b) by 0 days.

(21) Appl. No.: 15/597,528

(22) Filed: May 17, 2017

(65) Prior Publication Data

US 2017/0341884 A1 Nov. 30, 2017

Related U.S. Application Data

(60) Provisional application No. 62/342,166, filed on May 26, 2016.

(51) Int. Cl.

| | |
|---|---|
| ***B65H 3/34*** | (2006.01) |
| ***B65H 3/46*** | (2006.01) |
| ***B65H 3/04*** | (2006.01) |
| ***B65H 3/52*** | (2006.01) |
| ***B21D 43/24*** | (2006.01) |
| ***B65H 3/56*** | (2006.01) |
| ***B65H 3/06*** | (2006.01) |
| ***B65H 3/24*** | (2006.01) |

(52) U.S. Cl.

CPC ..... *B65H 3/46* (2013.01); *B21D 43/24* (2013.01); *B65H 3/047* (2013.01); *B65H 3/0623* (2013.01); *B65H 3/24* (2013.01); *B65H 3/5215* (2013.01); *B65H 3/5253* (2013.01); *B65H 3/56* (2013.01); *B65H 2301/4222* (2013.01)

(58) Field of Classification Search

CPC ... B65H 1/04; B65H 3/00; B65H 3/24; B65H 3/46; B65H 3/52; B65H 3/5246; B65H 3/5253; B65H 3/56; B65H 3/60; B65H 3/62; B65H 3/66; B65H 2402/31; B21D 43/24

See application file for complete search history.

(56) References Cited

U.S. PATENT DOCUMENTS

| | | | | |
|---|---|---|---|---|
| 2,827,288 A * | 3/1958 | Geisler | ..... | B65H 3/34 271/161 |
| 3,586,317 A * | 6/1971 | Smitzer | ..... | B65H 1/12 271/127 |
| 4,349,186 A * | 9/1982 | Nakamura | ..... | B65H 3/56 221/51 |

(Continued)

FOREIGN PATENT DOCUMENTS

| | | |
|---|---|---|
| JP | S5074080 | 11/1948 |
| JP | S5117985 | 7/1949 |

(Continued)

*Primary Examiner* — Prasad V Gokhale

(74) *Attorney, Agent, or Firm* — King & Schickli, PLLC

(57) ABSTRACT

An object of the invention is to provide a sheet materials separation-aiding apparatus capable of creating a gap between a specific sheet material and a sheet material coming into contact with the lower surface thereof even when the location precision of a stack of laminated sheet materials is low in the height direction of the stack of laminated sheet materials and in the direction orthogonal to the height direction.

20 Claims, 4 Drawing Sheets

(56) References Cited

U.S. PATENT DOCUMENTS

| | | | | |
|---|---|---|---|---|
| 2015/0202654 | A1* | 7/2015 | Kitagawa ..... | B65H 1/14<br>427/207.1 |
| 2017/0129724 | A1* | 5/2017 | Fujiwara ..... | B65H 1/04 |

FOREIGN PATENT DOCUMENTS

| | | |
|---|---|---|
| JP | S5168177 | 11/1949 |
| JP | S5074080 | 6/1975 |
| JP | S5117985 | 2/1976 |
| JP | S5168177 | 5/1976 |
| JP | 2001205373 | 7/2001 |
| WO | WO2008039129 | 4/2008 |

* cited by examiner

SHEET MATERIAL SEPARATION-AIDING APPARATUS

This application claims the benefit of U.S. Provisional Patent App. Ser. No. 62/342,166, the disclosure of which is incorporated by reference.

TECHNICAL FIELD

The present invention relates to a sheet materials separation-aiding apparatus (an auxiliary apparatus for sheet materials separation) that is provided in a sheet materials separator assembly of a material feeder for feeding laminated sheet materials one by one to the next step, and is capable of creating a gap between a specific sheet material of laminated sheet materials and a sheet material just below it so as to ensure that the delivered sheet materials are separated one by one.

BACKGROUND OF THE INVENTION

As multiple sheet materials are fed by the material feeder to the next processing machine upon processing of sheet materials, it may possibly cause the processing machine to get out of order.

In order to prevent a fault of such a processing machine, sheet materials must be fed from the material feeder one by one to the next step.

For the material feeder, it is thus required to make sure separation of one sheet material from the laminated sheet materials.

Although depending on the types of sheet materials, there are some sheet materials laminated together, each one having a lubricating oil, etc. on its smooth surface. Such sheet materials are kept in close contact with one another, and when the uppermost sheet material only is lifted up, multiple sheet materials are often lifted up due to the adsorption action created by a vacuum between the surfaces in close contact with one another.

Such sheet materials separation may be achieved by curling up the end of the sheet material to create a gap partly between that sheet material and a sheet material coming in contact with its lower surface and enlarging that gap entirely between that sheet material and the sheet just below it.

For an apparatus for creating a gap partly between that sheet material and a sheet material coming into contact with its lower surface, there is a sheet materials separation apparatus disclosed in Japanese Patent Application Publication No. 2001-205373.

This sheet materials separation apparatus comprises a linearly reciprocating actuator, a catching mechanism for catching an end of that sheet material, and a parallel linkage mechanism for converting the reciprocating linear motion of the actuator into an arc motion of the catching mechanism while maintaining its posture, wherein the catching mechanism that is driven by the actuator to move circularly while maintaining its posture catches and curls up the uppermost sheet.

SUMMARY OF THE INVENTION

Objects of the Invention

Referring to such a sheet materials separation apparatus as set forth above, it is required for the laminated sheet materials to have high location precision of the laminating direction of the laminated sheet materials with respect to the catching mechanism in order to catch and curl up the uppermost sheet material. A problem with this has been that it is required to make use of a lift capable of moving the laminated sheet material up and down with good enough precision or a mechanism capable of ascending and descending the sheet materials separation apparatus with good enough precision.

To ensure that the catching mechanism abuts against the end of the uppermost sheet material during its arc motion, the laminated sheet materials must have location precision in a direction orthogonal to the laminating direction of the laminated sheet materials. A problem with this has been that a support plate must be provided in such a way as to impart resistance to the ascending and descending sheet materials, resulting in an increase in the energy needed for moving up and down the sheet materials. Even when the sheet materials separation apparatus moves up and down by itself, the end of the uppermost sheet material must have location precision in both the laminating direction of the sheet materials and the direction orthogonal to that laminating direction, leading just only to the need for using a control system having sensors or the like incorporated in it but also to an increase in the required energy.

Having been made with the prior art problems in mind, the invention has for its object to provide an auxiliary apparatus for sheet materials separation (hereinafter called also as the sheet materials separation-aiding apparatus) capable of creating a gap partly between a specific sheet material and a sheet material coming in contact with its lower surface even when the location precision of laminated sheet materials is low in the laminating direction of laminated sheet materials and the direction orthogonal to that laminating direction.

To provide a solution to the aforesaid prior art problems, the present invention as the first aspect provides a sheet materials separation-aiding apparatus mounted on a sheet materials separator assembly for separating a specific sheet material from a stack of laminated sheet materials, said aiding-apparatus including a sheet materials separation-aiding member that is capable of coming close to, and going away from, an end of said laminated sheet materials stack and that has an abutment portion which abuts against an end of said specific sheet material as said aiding member comes close toward the end of said laminated sheet materials stack, wherein said abutment portion has a length in a laminating direction of said laminated sheet materials stack, said sheet materials separation-aiding member is rotatable about a center of rotation in a position that is below the lower end of said abutment portion and far more away from the end of said laminated sheet materials stack than from said abutment portion, and even with the end of said specific sheet material abutting against any position of the abutment portion in the laminating direction of the laminated sheet materials stack, there is an upward moment generated in said sheet materials separation-aiding member and that moment causes the sheet materials separation-aiding member to rotate about the center of rotation while said abutment portion keeps on abutting against said specific sheet material thereby creating a gap partly between said specific sheet material and the sheet material coming into contact with its lower surface, and after said abutment portion abuts against said specific sheet material to lift up said specific sheet material, said sheet materials separation-aiding member presses further in the end of said specific sheet material to bend said specific sheet material.

According to the sheet materials separation-aiding apparatus as the first aspect, because said sheet materials separation-aiding member is rotatable about a center of rotation in a position that is below the lower end of said abutment portion and far more away from the end of said laminated sheet materials stack than from said abutment portion, even with the end of said specific sheet material abutting against any position of the abutment portion in the laminating direction of the laminated sheet materials stack, there is an upward moment generated in said sheet materials separation-aiding member. That moment causes the sheet materials separation-aiding member to rotate about the center of rotation while said abutment portion keeps on abutting against said specific sheet material thereby creating a gap partly between said certain/specific sheet material and the sheet material coming into contact with its lower surface.

According to the sheet materials separation-aiding apparatus as the first aspect has an advantage of being capable of creating a gap between a specific sheet material and a sheet material remaining sticking to its lower surface by further pushing in the end of said specific sheet material to bend said specific sheet material even if sheet material is sticked to the lower surface of the specific sheet material when said specific sheet material is lifted up.

In the sheet materials separation-aiding apparatus as the second aspect, before said sheet materials separation-aiding member comes close to the end of said laminated sheet materials stack, said abutment portion is designed such that a distance to a straight line parallel with a laminating direction passing through the end of said laminated sheet materials stack is incremental from an upper end to a lower end of said abutment portion.

The sheet materials separation-aiding apparatus as the second aspect has, in addition to the advantage explained with reference to the first aspect, an advantage of being likely to first abut against an upper, specific sheet material of said laminated sheet materials stack when said sheet materials separation-aiding member comes close to the end of said laminated sheet materials stack, because said abutment portion is constructed as described above.

In the sheet materials separation-aiding apparatus as the third aspect, said sheet materials separation-aiding member is guided to said center of rotation after said abutment portion abuts against the end of said specific sheet and rotated about said center of rotation, and during rotation of said sheet materials separation-aiding member, said abutment portion remains pressed toward the end of said specific sheet material.

The sheet materials separation-aiding apparatus as the third aspect has in addition to the advantage explained with reference to the first or second aspect, an advantage of being capable of preventing a specific sheet material from going away and falling down from the abutment portion during rotation, because the abutment portion remains pressed toward the end of said specific sheet material during rotation of said sheet materials separation-aiding member. In addition, the aiding apparatus has another advantage of being capable of holding the sheet material by the abutment portion in a stable manner during rotation, again because the abutment portion remains pressed toward the end of said specific sheet material.

In the sheet materials separation-aiding apparatus as the fourth aspect, said center of rotation is displaced in a direction that said sheet materials separation-aiding member draws near and goes away, as said sheet materials separation-aiding member draws near and goes away.

The sheet materials separation-aiding apparatus as the fourth aspect has, in addition to the advantages described with reference to any one of the first, second and third aspects, an advantage of allowing the abutment portion to keep on abutting constantly against the end of a specific sheet material even when sheet materials separation-aiding member rotates. Further, access to a specific sheet material from a position away from the end of laminated sheet materials stack allows the abutment portion to abut against the end of a specific sheet material.

In the sheet materials separation-aiding apparatus as the fifth aspect, said specific sheet material is the uppermost sheet material.

The sheet materials separation-aiding apparatus as the fifth aspect has, in addition to the advantages described with reference to any one of the aforesaid aspects, an advantage of ensuring that to separate sheet materials one by one, there can be a gap created partly between the uppermost sheet material and a sheet material coming into contact with its lower surface.

According to the sheet materials separation-aiding apparatus of the sixth aspect, even during rotation of said abutment portion guided to about said center of rotation after abutment against the end of said specific sheet, a distance of said abutment portion relative to a straight line passing by the end of said laminated sheet and parallel with the laminating direction gets longer continuously from its upper end to its lower end.

According the sheet materials separation-aiding apparatus of the sixth aspect, there is, in addition to any one of the actions of said side, an advantage that when said abutment portion is guided to about said center of rotation and rotated to lift up said specific sheet material after abutment against the end of said specific sheet material and even when a sheet material stuck to the lower surface of said specific sheet material falls down, the falling down sheet is prevented from coming into contact with the abutment portion. Especially if the end of said specific sheet material is further pushed in to bend said specific sheet material, there is then a gap created between the specific sheet material and a material stuck to it. Even when the sheet material stuck to the lower surface of the specific sheet material falls down, the falling down sheet material is prevented from coming into contact with the abutment portion.

According to the invention as mentioned in any one of the above aspects, it is possible to create a gap partly between a specific sheet material and a sheet material coming into contact with its lower surface even when the location precision of laminated sheet materials is low in the laminating direction of laminated sheet materials and the direction orthogonal to that laminating direction.

MODES FOR CARRYING OUT THE INVENTION

Figure 1:
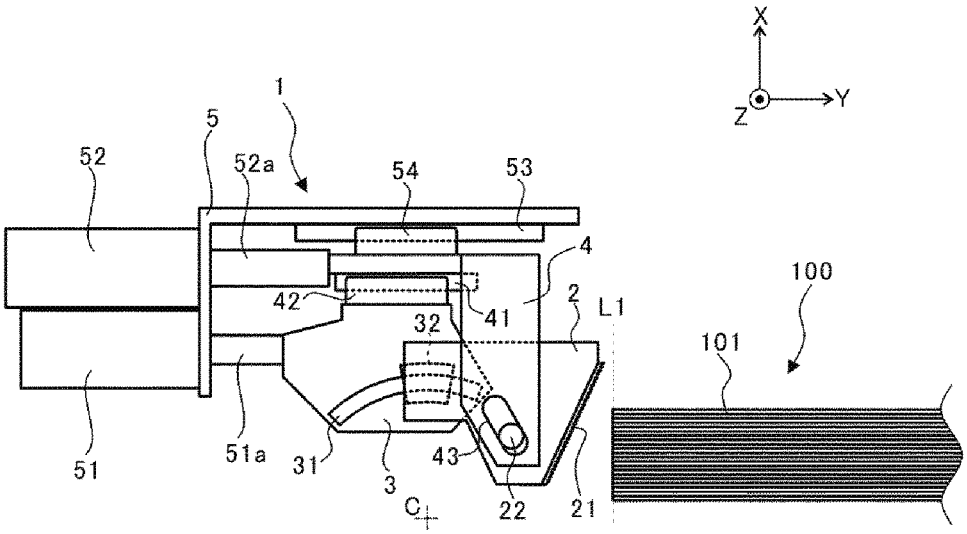
FIG. 1 is a side view of the sheet materials separation-aiding apparatus according to one embodiment of the invention wherein a part of the housing is removed so that the interior of the housing can be exposed to view, and shows a state of the apparatus before a sheet materials separation-aiding member is in abutment against the end of a stack of laminated sheet materials.

Reference is now made to a stack 100 of laminated sheet materials from which the uppermost sheet material 101 is separated by a sheet materials separator apparatus including a sheet materials separation-aiding apparatus 1 according to one embodiment of the invention.

A stack 100 of laminated sheet materials, as shown in the accompanying drawings, may be formed of a non-magnetic metal such as aluminum. The laminating direction is defined by the X-axis direction of the coordinate system shown. A direction in which a sheet materials separation-aiding member 2 to be described later, or the like, comes close to or goes away from the end of the laminated sheet materials stack 100 is defined by the Y-direction of the coordinate system shown.

The end of the laminated sheet materials stack 100 (not shown in FIGS. 1 to 7) opposite to the sheet materials separation-aiding apparatus 1 is in abutment against a stopper or the like with the result that the laminated sheet materials stack 100 does not move largely in the Y-axis direction.

In the sheet materials stack 100 formed of a non-magnetic metal such as aluminum, they are often laminated one upon another while each one has a lubricating oil or the like coated on a smooth surface of the sheet materials stack 100. In the stack 100, such laminated sheet materials are often brought in close contact with one another. For instance, even when only the uppermost sheet material 101 that is a specific sheet material is lifted up, a sheet material just below it remains sticking to it under a vacuum adsorption action between them.

As such multiple sheet materials are delivered to the next processing apparatus while they remain sticking to one another, it may possible cause the next processing apparatus to break down or give rise to poor processing. Therefore, it is necessary to make sure for separation of one only of the uppermost sheet material 101 from the laminated sheet materials stack 100.

In the case where the laminated sheet materials stack 100 is formed of a nonmagnetic metal or the like, it is impossible to rely upon magnetic separation of the uppermost sheet material 101.

Even with sheet materials formed of a nonmagnetic metal or the like, there is one possible method for separating sheet materials from one another by blowing air between adjacent sheets. To this end, however, a large amount of air must then be used, giving rise to much more increased energy consumption.

When reliance is placed upon a method for curling up the end of the sheet material by abutment, powdery shavings adhere to the sheet material, possibly resulting in poor processing at the next processing equipment.

The sheet materials separation-aiding apparatus 1 according to one embodiment of the invention capable of providing a solution to these problems is now explained.

The sheet materials separation-aiding apparatus 1 is provided on a sheet materials separator for separating a specific or uppermost sheet material 101 from a laminated sheet materials stack 100.

This sheet materials separation-aiding apparatus 1 comprises a sheet materials separation-aiding member 2 that is capable of coming close to or going away from an end of the laminated sheet materials stack 100, a first direct-acting member 3 to which the sheet materials separation-aiding member 2 is coupled for turning or rotation, and a second direct-acting member 4 that is coupled to the first direct-acting member 3 in such a way as to guide a linear reciprocating motion of the first direct-acting member 3 and coupled to the sheet materials separation-aiding member 2 in such a way as to guide the sheet materials separation-aiding member 2 in a constant range yet without disturbing the turning or rotation of that member 2.

In order from the negative direction toward positive direction of the Z-axis, the first direct-acting member 3, the sheet materials separation-aiding member 2 and the second direct-acting member 4 are provided.

Figure 2:
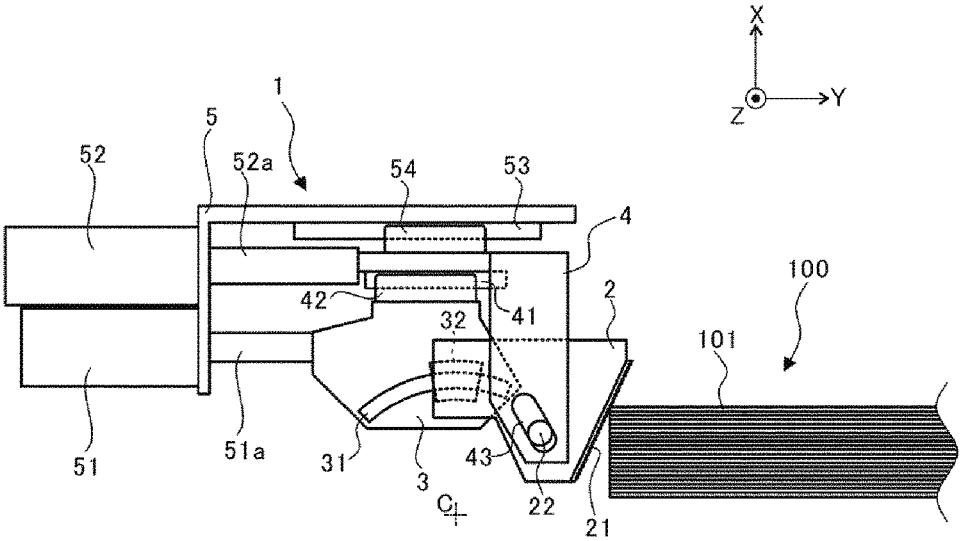
FIG. 2 is a side view of the sheet materials separation-aiding apparatus, and shows that the abutment portion of the sheet materials separation-aiding member is in abutment against a specific sheet material.

As shown in FIG. 2, the sheet materials separation-aiding member 2 is provided with an abutment portion 21 that abuts against the uppermost sheet material 101 as it comes close to the end of laminated sheet materials stack 100.

Before the sheet materials separation-aiding member 2 comes close to the end of the laminated sheet materials stack 100 as shown in FIG. 1, a distance between a one-dot chain line L1 defined by a straight line parallel with the laminating direction passing through the end of the laminated sheet materials stack 100 is incremental from the upper end to the lower end of the abutment portion 21.

The abutment portion 21 has a saw-toothed form. The saw-toothed form of the abutment portion 21 ensures that as the sheet materials separation-aiding member 2 turns or rotates while the abutment portion 2 is in abutment against the end of the uppermost sheet material 101, it causes the end of the uppermost sheet material 101 to get reliably caught on the abutment portion 21.

The abutment portion 21 is also designed such that its thickness gets short in the Z-axis direction and its abutment area against the end of the uppermost sheet material 101 is minimized. The end of the uppermost sheet material 101 getting reliably caught on the abutment portion 21, and the minimum abutment area of the abutment portion 21 makes sure prevention of the end of the uppermost sheet material 101 from generating powders by shaving.

Coupled to the first direct-acting member 3 is a cylinder rod 51*a* of a cylinder 51 fixed to the housing 5. Actuation of the cylinder 51 ensures that the cylinder rod 51*a* extends or contracts, causing the first direct-acting member 3 to come close to, and go away from, the end of the laminated sheet materials stack 100.

The first direct-acting member 3 comprises a curved guide 31 having a center of rotation C in a position that is below the lower end of the abutment portion 21 and far more away from the end of the laminated sheet materials stack 100 than from the abutment portion 21, and the sheet materials separation-aiding member 2 is fixed to a block 32 that moves along the curved guide 31.

The curved guide 31 and block 32 ensure that the rotational motion of the sheet materials separation-aiding member 2 is guided to around the center of rotation C in a position that is below the lower end of the abutment portion 21 and far more away from the end of the laminated sheet materials stack 100 than from the abutment portion 21. This rotational orbit lies on the same plane as, and parallel with, the XY-plane of the coordinate system shown.

As the sheet materials separation-aiding member 2 comes close or goes away, the center of rotation C of the sheet materials separation-aiding member 2 will be displace in the Y-axis direction orthogonal to the laminating or X-axis direction.

Coupled to the second direct-acting member 4 is a cylinder rod 52*a* of a cylinder 52 fixed to the housing 5. Actuation of the cylinder 52 ensures that the cylinder rod 52*a* extends or contracts, causing the second direct-acting member 4 to come close to, and go away from, the end of the laminated sheet materials stack 100.

The second direct-acting member 4 comprises a linear guide 41, and the first direct-acting member 3 is fixed to a block 42 that moves along that linear guide 41. The linear guide 41 and block 42 allow for guidance of the linearly reciprocating motion of the first direct-acting member 3.

The sheet materials separation-aiding member 2 further comprises a protruding guide portion 22 that extends out in the Z-axis direction, and is here inserted into a guide groove 43 formed in the second direct-acting member 4. The sheet materials separation-aiding member 2 is capable of rotation about the protruding guide portion 22 inserted into the guide groove 43, and of displacement in a given range along the guide groove 43 as well. It is thus possible for the second direct-acting member 4 to guide the sheet materials separation-aiding member 2 within a constant range yet without disturbing the rotation of the sheet materials separation-aiding member 2.

The housing 5 comprises a linear guide 53 inside, and the second direct-acting member 4 is fixed to a block 54 that moves along the linear guide 53. The linear guide 53 and block 54 allow for guidance of the linearly reciprocating motion of the second direct-acting member 4.

The operation of the sheet materials separation-aiding apparatus 1 is now explained.

FIG. 1 is illustrative of a state of the sheet materials separation-aiding apparatus 1 before the sheet materials separation-aiding member abuts against the end of the laminated sheet materials stack. Specifically, FIG. 1 shows that in association with the motions of the first direct-acting member 3 and the second direct-acting member 4, the sheet materials separation-aiding member 2 coupled to the first direct-acting member 3 and the second direct-acting member 4 comes close to the end of the laminated sheet materials stack 100.

Extension of the cylinder rod 51*a* from the state of FIG. 1 by the actuation of the cylinder 51 causes the first direct-acting member 3 to move linearly toward the end of the laminated sheet materials stack 100. Co-actuation of the cylinder 52 permits the cylinder rod 52*a* to extend so that the second direct-acting member 4 moves linearly toward the end of the laminated sheet materials stack 100.

In association with such motions of the first direct-acting member 3 and the second direct-acting member 4, the sheet material separation-aiding member 2 coupled to the first direct-acting member 3 and the second direct-acting member 4 comes close toward the end of the laminated sheet materials stack 100.

FIG. 2 shows in what state the abutment portion 21 of the sheet materials separation-aiding member 2 abuts against the uppermost sheet material 101 that is one of the laminated sheet materials 100.

The cylinders 51 and 52 keep going, and the abutment portion 21 continues to press on the end of the uppermost sheet material 101. Counterforce resulting from the pressing of the abutment portion 21 on the end of the uppermost sheet material 101 brings about an upward moment in the sheet materials separation-aiding member 2 around the center of rotation C, getting the rotation of the sheet materials separation-aiding member 2 started.

The sheet materials separation-aiding member 2 starts to rotate by the counterforce; there is no need for controlling the operation of the cylinders 51 and 52, etc.

The rotation of the sheet materials separation-aiding member 2 may bring about a gap partly between the uppermost sheet material 101 and the sheet material just below it. As the rotation of the sheet materials separation-aiding member 2 keeps going, this gap grows entirely between the uppermost sheet material 101 and the sheet material coming into contact with its lower surface.

Figure 3:
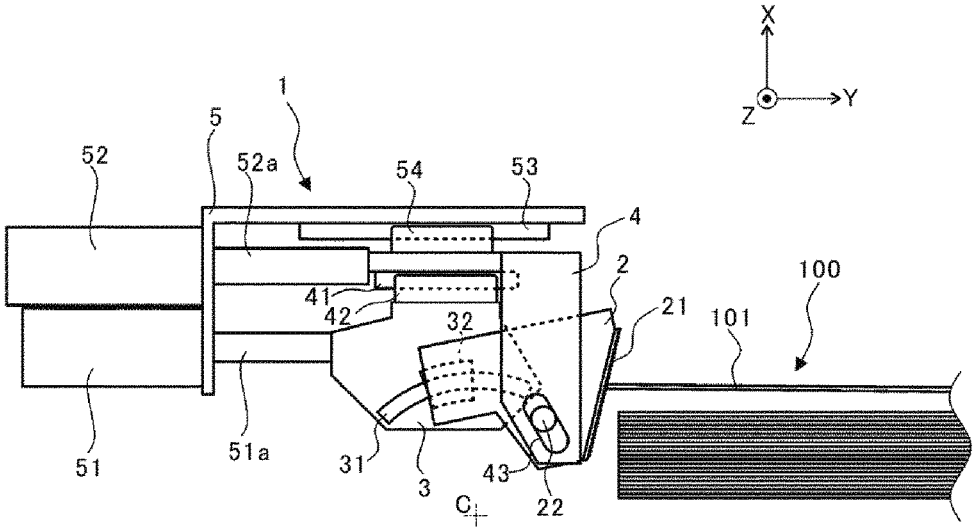
FIG. 3 is a side view of the sheet materials separation-aiding apparatus of FIG. 1, and shows that the sheet separations separation-aiding member turns or rotates while the abutment portion is in abutment against a specific sheet material.

FIG. 3 shows that the sheet materials separation-aiding member 2 rotates while the abutment portion 21 remains in abutment against the uppermost sheet material 101.

The cylinders 51 and 52 keep going. By the operation of the cylinder 52 in particular, the second direct-acting member 4 is pressed toward the end of the uppermost sheet material 101. As this second direct-acing member 4 further presses the protruding guide portion 22 of the sheet materials separation-aiding member 2 against the end of the uppermost sheet material 101, it causes the abutment portion 21 of the sheet materials separation-aiding member 2 to be pressed toward the end of the uppermost sheet material 101.

The operation of the cylinder 51 also causes the second direct-acting member 4 to be pressed toward the end of the uppermost sheet material 101, the sheet materials separation-aiding member 2 to be pressed toward the end of the uppermost sheet material 101 via the curved guide 31, the block 32, and the abutment portion 21 of the sheet materials separation-aiding member 2 to be pressed toward the end of the uppermost sheet material 101.

This ensures that during the rotation of the sheet materials separation-aiding member 2 too, the abutment portion 21 is pressed toward the end of the uppermost sheet material 101. The pressing of the abutment portion 21 ensures that during the rotation of the sheet materials separation-aiding member 2, the uppermost sheet material 101 is stably lifted up during which it does not go away from the end of the uppermost sheet material 101.

Figure 4:
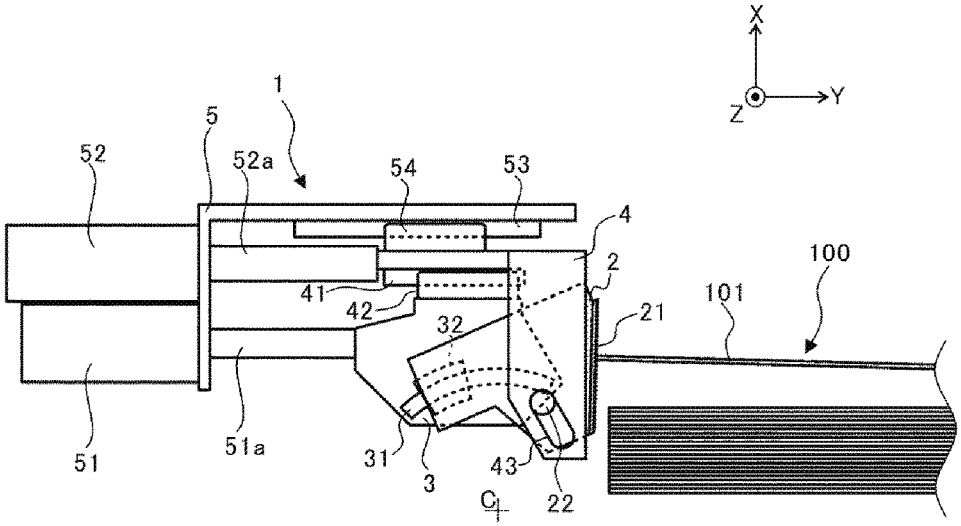
FIG. 4 is a side view of the sheet materials separation-aiding apparatus of FIG. 1, and shows that the sheet materials separation-aiding member lifts up a specific sheet material while the abutment portion is in abutment against the specific sheet material.

FIG. 4 shows that after the rotation of the sheet materials separation-aiding member 2 gets done, the uppermost sheet material 101 is lifted up and away.

In the sheet materials separation-aiding apparatus 1, as shown in FIG. 1, the sheet materials separation-aiding member 2 draws near from a position away from the end of the laminated sheet materials stack 100 in the Y-axis direction, and after it abuts against the uppermost sheet material 101, the rotation of the sheet materials separation-aiding member 2 gets started, as shown in FIG. 2.

Even when the location precision of the laminated sheet materials stack 100 in the Y-axis direction and the end face precision of the sheet materials stack are low, it is thus possible to separate off the uppermost sheet material 101.

By extension of the strokes of the cylinder rods 51*a* and 52*a* of the cylinders 51 and 52, it is possible to separate off the uppermost sheet material 101 from a position far away from the end of the laminated sheet materials stack 100 in the Y-axis direction.

Figure 5:
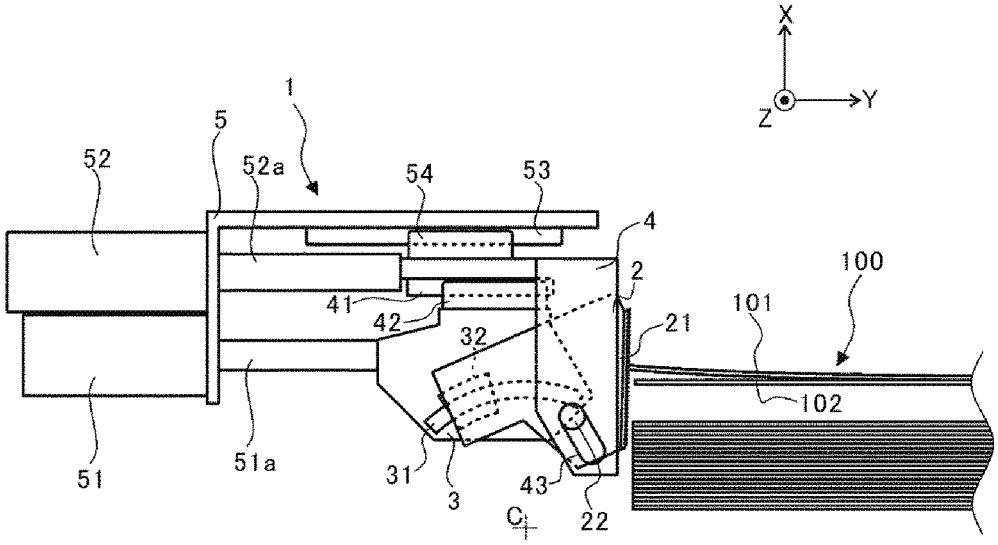
FIG. 5 is a side view of the sheet materials separation-aiding apparatus of FIG. 1, and shows that when a specific sheet material has another sheet material remaining sticking to its lower surface, the abutment portion of the sheet materials separation-aiding member presses further in the end of the specific sheet material to bend the specific sheet material.

As shown in FIG. 5, the uppermost sheet material 101 is sometimes lifted up while a sheet material 102 remains sticking to the lower surface of the uppermost sheet material 101. Even in such a case, it is possible to bend the uppermost sheet material 101 by allowing the abutment portion 21 to further press in the uppermost sheet material 101. Bending of the uppermost sheet material 101 can cause a gap to occur between the uppermost sheet material 101 and the sheet material 102 that remains sticking to it.

As the gap grows entirely between the uppermost sheet material 101 and the sheet material 102 coming into contact with the lower surface of the sheet material 101, it allows the sheet material 102 to fall down, ensuring that the uppermost sheet material 101 gets separated off, as shown in FIG. 4.

Figure 6:
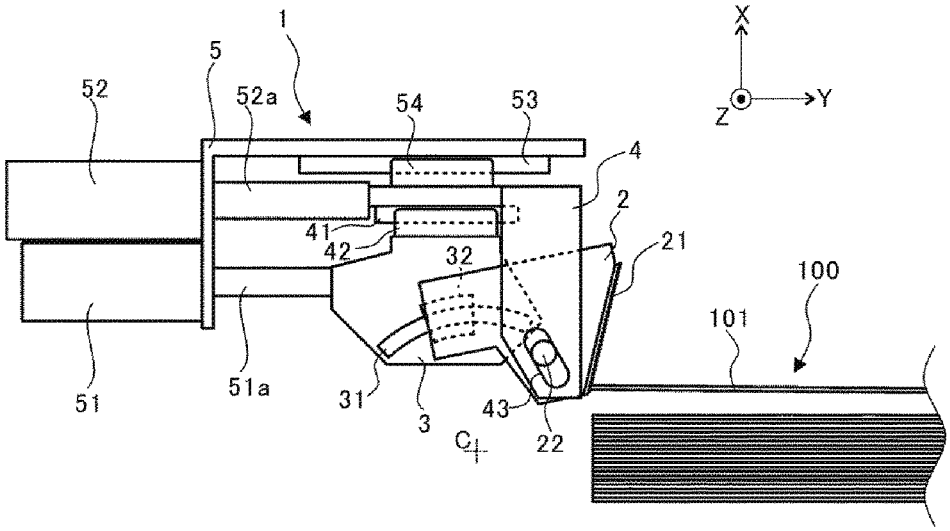
FIG. 6 is a side view of the sheet materials separation-aiding apparatus of FIG. 1, and shows that the sheet materials separation-aiding member turns or rotates while the abutment portion of the sheet materials separation-aiding member remains abutting against a specific sheet material in the vicinity of its lower end.

FIG. 6 shows that the sheet materials separation-aiding member 2 is rotating while the end of the uppermost sheet material 101 remains abutting against near the lower end of the abutment portion 21 of the sheet materials separation-aiding member 2.

Figure 7:
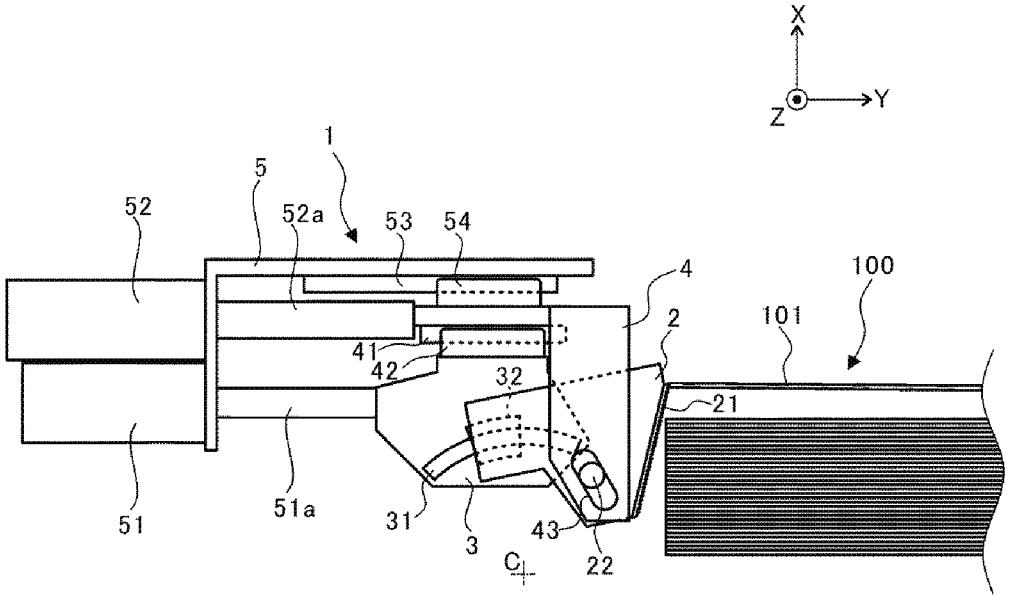
FIG. 7 is a side view of the sheet materials separation-aiding apparatus of FIG. 1, and shows that the sheet materials separation-aiding member turns or rotates while the abutment portion of the sheet materials separation-aiding member remains abutting against a specific sheet material in the vicinity of its upper end.

FIG. 7 shows that the sheet materials separation-aiding member 2 is rotating while the end of the uppermost sheet material 101 remains abutting against near the upper end of the abutment portion 21 of the sheet materials separation-aiding member 2.

The sheet materials separation-aiding apparatus 1 is found in a position where the center of rotation C lies in a position that is below the lower end of the abutment portion 21 and far more away from the end of the laminated sheet materials stack 100 than from the abutment portion 21. Even when the end of the uppermost sheet material 101 abuts against any position of the abutment portion 21 in the X-axis direction as shown in FIGS. 6 and 7, therefore, there is counterforce produced by the pressing of the abutment portion 21 against the end of the uppermost sheet material 101.

This counterforce brings about an upward moment in the sheet materials separation-aiding member 2 around the center of rotation C, getting the rotation of the sheet materials separation-aiding member 2 started. The rotation of the sheet materials separation-aiding member 2 may bring about a gap partly between the uppermost sheet material 101 and the sheet material coming into contact with the lower surface thereof.

It is thus possible to separate off the uppermost sheet material 101 even when the location precision of the laminated sheet materials stack 100 is low in the X-axis direction. Even when delivery keeps going and there is a variation in the height of the laminated sheet materials stack 100, it is possible to separate off the uppermost sheet material 101 if such a height variation is within a range where the abutment portion 21 can abut against the end of the laminated sheet materials stack 100. There is then no need for moving up and down the laminated sheet materials stack 100 or the whole sheet materials separation-aiding apparatus 1.

Figure 8:
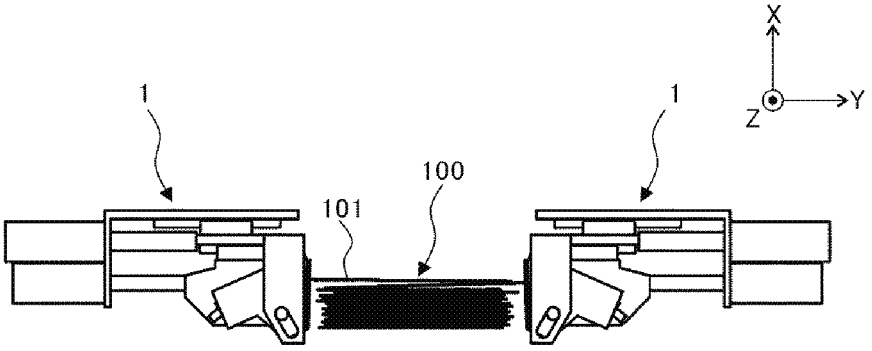
FIG. 8 is a side view of two sheet materials separation-aiding apparatus of FIG. 1 located on both sides of a laminated sheet materials stack.

On both sides of a stack of laminated sheet materials 100 that are largely displaced in the Y-axis direction, as shown in FIG. 8, two sheet materials separation-aiding apparatus 1 according to the embodiment described herein may be provided. For instance, the right sheet materials separation-aiding apparatus 1 abuts against and lifts up the end of a sheet material just below the uppermost sheet material 101, and the left sheet materials separation-aiding apparatus 1 abuts against and lifts up the end of the uppermost sheet material 101. Even with the stack of laminated sheet materials 100 that are largely displaced in the Y-axis direction, it is thus possible to bring about a gap partly between the uppermost sheet material 101 and a sheet material coming into contact with the lower surface thereof.

In the sheet materials separation-aiding apparatus 1 according to the aforesaid embodiment, there is the gap growing wide entirely between the uppermost sheet material 101 and a sheet material coming into contact with the lower surface thereof however, there may be only a partial gap present between the uppermost sheet material 101 and a sheet material coming into contact with the lower surface thereof.

By blowing an air into a gap created by the sheet materials separation-aiding apparatus 1 or, alternatively, hoisting a vacuum cup adsorbed onto the upper surface of the uppermost sheet material 101 or the like, it is also possible to grow a gap entirely between the uppermost sheet material 101 and a sheet material into contact with the lower surface thereof thereby allowing for complete separation of the uppermost sheet material 101 out of the sheet material just below it.

In the aforesaid embodiment, the laminated sheet material are each formed of a nonmagnetic metal such as aluminum as explained above; by way of example but not by way of limitation, each individual sheet material may be formed of a magnetic metal or a nonmetal material such as resin or paper.

In the aforesaid embodiment, the abutment portion 21 has a saw-toothed shape as explained above; however, the invention is not limited thereto and instead, use may be made of an arrangement wherein a frictional force enough to prevent the sheet material from falling down during rotation is generated between the abutment portion and the end of a sheet material against which it abuts.

In the aforesaid embodiment, the rotation motion of the sheet materials separation-aiding member 2 is guided by the curved guide 31 and block 32 as explained above; however, the invention is not limited thereto and instead, use may be made of a guide groove or other means capable of achieving the rotational motion of the sheet materials separation-aiding member.

In the aforesaid embodiment, there is one center of rotation provided as explained above; however, the invention is not limited thereto and instead, two or more centers of rotation may be provided.

In the aforesaid embodiment, the first and the second direct-acting members are put into motion by the associated cylinders 51 and 52, respectively; however, the invention is not limited thereto and instead, the first and the second direct-acting members may be put into motion by other actuator.

In the aforesaid embodiment, the second direct-acting member 4 guides the sheet materials separation-aiding member 2 within a constant range by means of the guide groove 43 in the second direct-acting member 4 and the protruding guide portion 22 of the sheet materials separation-aiding member 2 as explained above; however, the invention is not limited thereto and instead, use may be made of a block and a linear guide to which the sheet materials separation-aiding member is rotatably coupled or other means that does not disturb the rotation of the sheet materials separation-aiding member.

EXPLANATION OF THE REFERENCE NUMERALS

1; Sheet materials separation-aiding apparatus
2: Sheet materials separation-aiding member
3: First direct-acting member
4: Second direct-acting member
5: Housing
21: Abutment portion
22: Protruding guide portion
31: Curved guide
32, 42, 54: Block
41, 53: Linear guide
43: Guide groove
51, 52: Cylinder
51*a*, 52*a*: Cylinder rod
100: Laminated sheet materials stack
101: Uppermost sheet material
102: Sheet material sticking to the lower surface of the uppermost sheet material

What is claimed is:

1. A sheet materials separation-aiding apparatus mounted on a sheet materials separator assembly for separating a specific sheet material from a stack of laminated sheet materials, characterized by including a sheet materials separation-aiding member that is capable of coming close to, and going away from, an end of said laminated sheet materials stack and that has an abutment portion which abuts against an end of said specific sheet material as said aiding member comes close toward the end of said laminated sheet materials stack, wherein:

said abutment portion has a length in a laminating direction of said laminated sheet materials stack, said sheet materials separation-aiding member is rotatable about a center of rotation in a position that is below the lower end of said abutment portion and far more away from the end of said laminated sheet materials stack than from said abutment portion, even with the end of said specific sheet material abutting against any position of the abutment portion in the laminating direction of the laminated sheet materials stack, there is an upward moment generated in said sheet materials separation-aiding member and that moment causes the sheet materials separation-aiding member to rotate about the center of rotation while said abutment portion keeps on abutting against said specific sheet material thereby creating a gap partly between said specific sheet material and the sheet material coming into contact with its lower surface and after said abutment portion abuts against said specific sheet material to lift up said specific sheet material, said sheet materials separation-aiding member presses further in the end of said specific sheet material to bend said specific sheet material.

2. A sheet materials separation-aiding apparatus as recited in claim 1, characterized in that before said sheet materials separation-aiding member comes close to the end of said laminated sheet materials stack, said abutment portion is designed such that a distance to a straight line parallel with a laminating direction passing through the end of said laminated sheet materials stack is incremental from an upper end to a lower end of said abutment portion.

3. A sheet materials separation-aiding apparatus as recited in claim 2, characterized in that said sheet materials separation-aiding member is guided to said center of rotation after said abutment portion abuts against the end of said specific sheet and rotated about said center of rotation, and during rotation of said sheet materials separation-aiding member, said abutment portion remains pressed toward the end of said specific sheet material.

4. A sheet materials separation-aiding apparatus as recited in claim 3, characterized in that said center of rotation is displaced in a direction that said sheet materials separation-aiding member draws near and goes away as said sheet materials separation-aiding member draws near and goes away.

5. A sheet materials separation-aiding apparatus as recited in claim 4, characterized in that even during rotation of said abutment portion guided to about said center of rotation after abutment against the end of said specific sheet, a distance of said abutment portion relative to a straight line passing by the end of said laminated sheet and parallel with the laminating direction gets longer continuously from its upper end to its lower end.

6. A sheet materials separation-aiding apparatus as recited in claim 5, characterized in that said specific sheet material is the uppermost sheet material.

7. A sheet materials separation-aiding apparatus as recited in claim 3, characterized in that even during rotation of said abutment portion guided to about said center of rotation after abutment against the end of said specific sheet, a distance of said abutment portion relative to a straight line passing by the end of said laminated sheet and parallel with the laminating direction gets longer continuously from its upper end to its lower end.

8. A sheet materials separation-aiding apparatus as recited in claim 7, characterized in that said specific sheet material is the uppermost sheet material.

9. A sheet materials separation-aiding apparatus as recited in claim 2, characterized in that said center of rotation is displaced in a direction that said sheet materials separation-aiding member draws near and goes away as said sheet materials separation-aiding member draws near and goes away.

10. A sheet materials separation-aiding apparatus as recited in claim 9, characterized in that even during rotation of said abutment portion guided to about said center of rotation after abutment against the end of said specific sheet, a distance of said abutment portion relative to a straight line passing by the end of said laminated sheet and parallel with the laminating direction gets longer continuously from its upper end to its lower end.

11. A sheet materials separation-aiding apparatus as recited in claim 2, characterized in that even during rotation of said abutment portion guided to about said center of rotation after abutment against the end of said specific sheet, a distance of said abutment portion relative to a straight line passing by the end of said laminated sheet and parallel with the laminating direction gets longer continuously from its upper end to its lower end.

12. A sheet materials separation-aiding apparatus as recited in claim 1, characterized in that said sheet materials separation-aiding member is guided to said center of rotation after said abutment portion abuts against the end of said specific sheet and rotated about said center of rotation, and during rotation of said sheet materials separation-aiding member, said abutment portion remains pressed toward the end of said specific sheet material.

13. A sheet materials separation-aiding apparatus as recited in claim 12, characterized in that said center of rotation is displaced in a direction that said sheet materials separation-aiding member draws near and goes away as said sheet materials separation-aiding member draws near and goes away.

14. A sheet materials separation-aiding apparatus as recited in claim 13, characterized in that even during rotation of said abutment portion guided to about said center of rotation after abutment against the end of said specific sheet, a distance of said abutment portion relative to a straight line passing by the end of said laminated sheet and parallel with the laminating direction gets longer continuously from its upper end to its lower end.

15. A sheet materials separation-aiding apparatus as recited in claim 12, characterized in that even during rotation of said abutment portion guided to about said center of rotation after abutment against the end of said specific sheet, a distance of said abutment portion relative to a straight line passing by the end of said laminated sheet and parallel with the laminating direction gets longer continuously from its upper end to its lower end.

16. A sheet materials separation-aiding apparatus as recited in claim 15, characterized in that said specific sheet material is the uppermost sheet material.

17. A sheet materials separation-aiding apparatus as recited in claim 1, characterized in that said center of rotation is displaced in a direction that said sheet materials separation-aiding member draws near and goes away as said sheet materials separation-aiding member draws near and goes away.

18. A sheet materials separation-aiding apparatus as recited in claim 17, characterized in that even during rotation of said abutment portion guided to about said center of rotation after abutment against the end of said specific sheet, a distance of said abutment portion relative to a straight line passing by the end of said laminated sheet and parallel with the laminating direction gets longer continuously from its upper end to its lower end.

19. A sheet materials separation-aiding apparatus as recited in claim 1, characterized in that even during rotation of said abutment portion guided to about said center of rotation after abutment against the end of said specific sheet, a distance of said abutment portion relative to a straight line passing by the end of said laminated sheet and parallel with the laminating direction gets longer continuously from its upper end to its lower end.

20. A sheet materials separation-aiding apparatus as recited in claim 1, characterized in that said specific sheet material is the uppermost sheet material.

* * * * *